United States Patent [19]

Lockwood

[11] 4,395,830

[45] Aug. 2, 1983

[54] PULSE COMBUSTION FLUIDIZING DRYER

[75] Inventor: Raymond M. Lockwood, Los Altos, Calif.

[73] Assignee: Jetsonic Processes, Ltd., Los Altos, Calif.

[21] Appl. No.: 300,180

[22] Filed: Sep. 8, 1981

Related U.S. Application Data

[63] Continuation-in-part of Ser. No. 186,642, Sep. 12, 1980, abandoned.

[51] Int. Cl.[3] ..... F26B 3/08

[52] U.S. Cl. ..... 34/10; 34/57 A; 34/57 D; 34/57 E; 34/191; 432/15; 432/58

[58] Field of Search ..... 34/10, 57 A, 57 B, 57 D, 34/57 E, 34, 181, 164; 159/4 A, 4 E, 16 R; 432/15, 58

[56] References Cited

U.S. PATENT DOCUMENTS 4,226,668 10/1980 Ferguson ..... 159/4 A

*Primary Examiner*—Larry I. Schwartz

*Attorney, Agent, or Firm*—Christie, Parker & Hale

[57] ABSTRACT

A fluid bed dryer includes a tank with an upright wall, a top, and a floor which rotates under a plurality of blades adjacent the floor and fixed to an inner annular baffle. A gas manifold is defined between the tank wall and the baffle, and opens under the baffle into a drying space in the tank.

A pulse jet engine pumps pulsating hot gas and sonic waves to the gas manifold to fluidize a bed of moist particles which are introduced into the drying space above the blades. There is a time average uniform exposure of the bed to the fluidizing gas effected by continuously changing the exposure of the particles to the gas. Pulsating hot gas and sonic energy waves flow from the periphery of the tank toward the center of the dryer. The pulse jet engine also supplies an auxiliary gas inlet at the side of the tank to maintain a swirl of gas above the fluidized bed. An adjustable bypass diverts the flow of gas from the auxiliary inlet to the gas manifold for adjusting the strength of the gas swirl. Gas and dried products are withdrawn from the dryer, and the gas is recycled to the tailpipe end of the pulse jet engine. The pulse jet inlet is supercharged to provide sufficient oxygen to support continuous combustion. The supercharged atmosphere is kept from feeding the tailpipe exhaust. Drying proceeds in an inert atmosphere.

51 Claims, 13 Drawing Figures

175
173
174
173
172
171
168
165
170
169
166
167

PULSE COMBUSTION FLUIDIZING DRYER

CROSS REFERENCE TO RELATED APPLICATION

This is a continuation-in-part of U.S. Ser. No. 186,642, filed Sept. 12, 1980, entitled "Pulse Jet Slurry Dryer", now abandoned, which is hereby incorporated by reference.

FIELD OF THE INVENTION

This invention provides a new and improved system for drying food and other moist products.

BACKGROUND OF THE INVENTION

The art and science of drying foodstuffs is vital to our society. Freshly harvested foods require dehydration if they are to be stored without spoilage.

Drying equipment is a substantial capital investment. However, most dryers are tailored for particular needs and operate only on a limited seasonal basis. The rest of the year they often sit idle. So far as is known, an all-purpose dryer has never been designed.

Direct-fired rotary dryers have high volume capacity, but are cumbersome and require operating temperatures which may scorch the product.

Flash dryers offer rapid drying, but do not handle liquids or slurries nor remove occluded moisture from inside the food.

Spray dryers are useful for only a limited range of materials.

Fluid-bed dryers are a step forward in achieving continuous drying. Fluidization offers uniform temperatures and high heat- and mass-transfer rates. However, fluid-bed dryers do not easily accommodate sticky feeds; tend to overdry delicate product and often "short circuit" particles through the drying path. Moreover, the fluidizing medium is much hotter than the bed itself and can scorch or burn the product if fluidization is interrupted.

In the typical fluid-bed drying, a bed of material rests on a perforated grid. Hot pressurized gas flows upwardly through the grid and fluidizes the bed. Yet it is difficult to keep a bed fluidized. A large number of particles tend to clump together rather than float individually in streams of air. The fluidized bed tends to become nonuniform. The gas eventually geysers or erupts through some weak spot in the bed and fluidization collapses. In addition, sticky particles sometimes "glue" together and resist fluidization. Moreover, sticky fluids can clog the grid and block the gas flow.

Attempts were made to solve these problems by uniformly exposing the material to the hot gas. Care was taken to not disturb the bed to avoid generating weak spots which could disrupt fluidization.

One proposed fluid-bed dryer is shown in U.S. Pat. No. 3,592,395, filed Sept. 16, 1968, to Lockwood et al. Hot gas and fresh slurry enter the dryer at its center and flow toward an outer wall. The gas is much hotter than the slurry and initially contacts a relatively small slurry volume. This tends to scorch or burn the product. Moreover, during startup and shutdown, material sometimes tumbles down the centrally-located hot gas inlet and causes fires.

There are problems in handling an assortment of particles having differing masses and volumes. Light particles may need only a short exposure, while heavier particles require longer processing which would overdry the lighter product. There is need for a dryer which can dehydrate light and heavy particles together yet provide a uniformly dried product. There is also need for a dryer which is versatile enough to handle sticky material.

SUMMARY OF THE INVENTION

This invention provides a dryer in which there is a time-average uniform exposure of the bed to the fluidizing gases. The exposure is not continuously uniform; a mechanically-imparted relative motion between the bed and the gases causes the entire bed to move past fluidizing gas streams with individual particles contacting gas every several seconds on the average. No particle is constantly exposed to the hot gas for any substantial period of time. The continuously uneven exposure enables the entire bed to fluidize for as long as desired.

The hot gas enters over the edge of a solid floor and initially contacts material which is distributed over a relatively large volume. This keeps the slurry from being scorched by excess contact time with hot gas. The gas is directed along the floor and penetrates all portions of the bed. By entering at the edge of the floor, the gas continuously sweeps material away from the gas inlet even during startup and shutdown to eliminate the fire hazard present in the prior art dryer.

In terms of apparatus, this invention provides a tank with a drying space above a floor having an edge and a central area. A gas directing means directs gas in the drying space from the edge to the central area. A particle introducing means introduces moist particles into the drying space to form a bed of particles. Means are provided for introducing a fluidizing gas at the edge of the floor. The gas flows into the drying space via the directing means and generates rising streams of gas along the floor to fluidize the bed. Means are also provided for withdrawing dried particles and gas from the drying space.

In the presently preferred embodiment, inclined blades along the floor direct gas from the edge to the central area. It is preferred that either the floor or the blades rotates relative to the other about an upright sleeve through the center of the floor. The blades sweep particles off the floor and direct the fluidizing streams into this material.

An upright baffle in the tank, spaced from an outer tank wall and the floor, forms a gas manifold into which hot gas flows from an inlet around the side of the tank. The manifold directs the incoming gas to the edge of the floor under the baffle and into the drying space. The blades function as a path of low impedence to direct the gas along the floor to penetrate to the center of the bed.

Fresh material enters through an inlet in the side of the tank and drops into an outer portion of the bed. Preferably a stirring arm spreads the material around the bed. Streams of gas generated from under the blades fluidize the particles. Dried product is removed from an overflow drain through the floor and also from an outlet in the top of the tank.

Preferably a pulse jet engine supplies pulsating hot gas and sonic energy from a pair of engine exhausts. In another aspect of this invention, one exhaust supplies an auxiliary gas inlet through a side wall of the tank. Gas flowing through this inlet enters the drying space on a tangent and swirls above the fluidized bed. The swirl picks up material from the top of the bed for further processing. The other engine exhaust supplies the gas manifold, which directs fluidizing gas into the bottom of the drying space in the same tangential direction as gas from the auxiliary inlet.

In yet another aspect of this invention, processing times of the particles are controlled by adjusting the swirl strength. A shunt selectively diverts gas from the auxiliary inlet to the gas manifold. The relative proportions of gas flowing into the auxiliary inlet and the gas manifold are adjustable. Both the fluidizing pressure and the strength of the swirl may be selected. The swirl can be insignificant or it can generate a vortex powerful enough to centrifugally separate moisture from entrained particles. Dried particles are carried by stack gases through an outlet in the top of the tank. Preferably a cyclone separator separates and collects the product. Stack gases are preferably recycled to the pulse jet engine.

In terms of method, the invention includes forming a bed of particles in a drying space having bottom and side boundaries and introducing a fluidizing gas from a periphery of the bottom boundary. A portion of this gas is directed into a central area to generate fluidizing gas streams along the bottom boundary. The bed is fluidized with a time average uniform exposure by continuously changing the exposure of the particles to these streams.

The particle exposure is preferably made to vary by imparting relative motion between the bed and the places of generation of the fluidizing streams. The generation preferably occurs along ducting blades in the drying zone spaced from the bottom boundary or floor. Preferably the bed is stirred to further expose all the particles to the streams. The blades shear the bed material and direct the gas streams upward to fluidize the particles. After the particles reach the desired degree of dryness, they are preferably carried from the dryer by stack gas.

An advantage of the invention is that the gas enters the drying space so that the ratio of hot gas to particles is lowest where the gas is the hottest. Since either the floor or the blades preferably rotate relative to the other about an upright axis, the relative motion is greatest where the gas is hottest to maximize heat transfer into the bed.

This invention also provides a method for dehydrating particles in an oxygen depleted atmosphere. A pulse jet engine has a tailpipe exhaust and an inlet exhaust. The tailpipe exhaust opens into one atmosphere while the inlet exhaust is adapted to conduct oxygen containing gas from another atmosphere to a combustion chamber to support ignition which generates pulsating hot gas and sonic energy. Moist particles are introduced into a dryer and moisture is removed by the pulsating hot gas and sonic energy. Gas containing moisture is withdrawn from the dryer and moisture is removed from this gas.

The moisture depleted gas is recycled to the atmosphere at the tailpipe exhaust. The inlet exhaust is supercharged to provide sufficient oxygen to support continuous combustion. The atmosphere feeding the inlet exhaust is kept separate from the other atmosphere. Dehydration then proceeds in an oxygen depleted atmosphere.

A further advantage of this invention is that it is portable and completely self-contained and may be used year-round to accomodate differing seasonal needs.

Other advantages and features of this invention will become apparent in the following specification and accompanying claims.

DESCRIPTION OF THE DRAWINGS

FIG. 6 is a perspective of a pulse jet engine for the slurry dryer;

FIG. 8 is a plan view of a portable slurry dryer system according to this invention;

FIG. 9 is a side elevation of the portable slurry dryer system;

DESCRIPTION OF THE ILLUSTRATED EMBODIMENT

Figure 1:
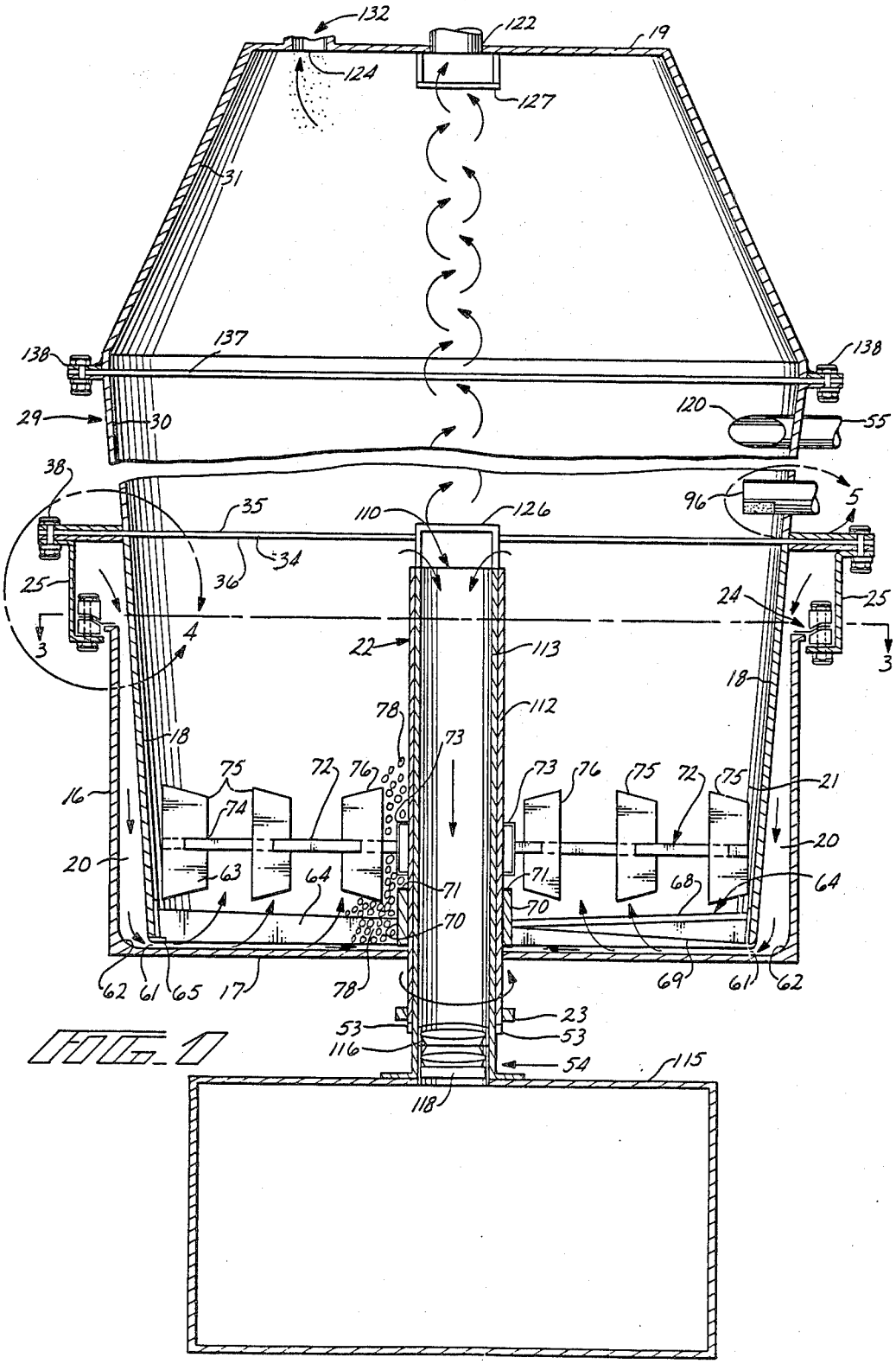
FIG. 1 is a side elevation of a slurry drying tank according to this invention.
Figure 2:
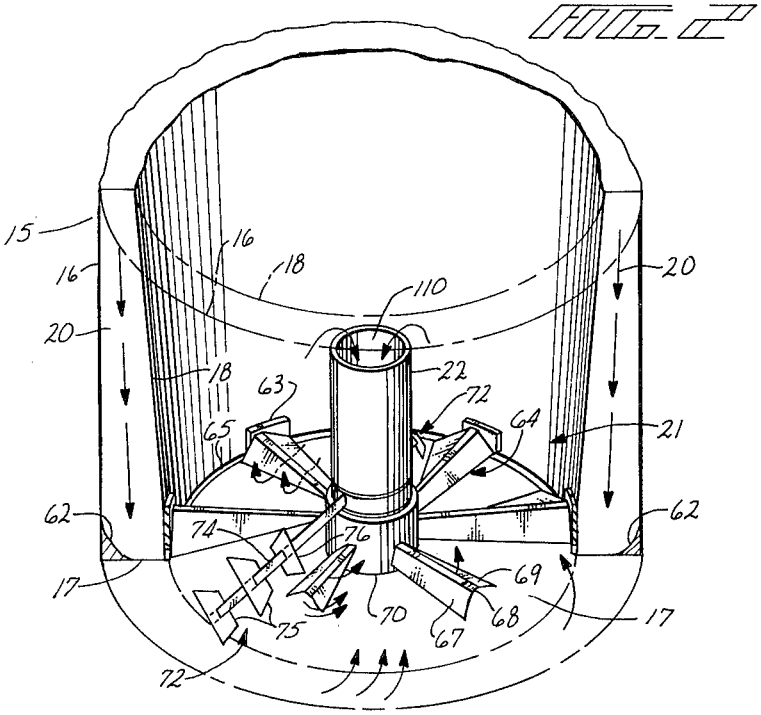
FIG. 2 is a partial perspective of the drying tank.
Figure 3:
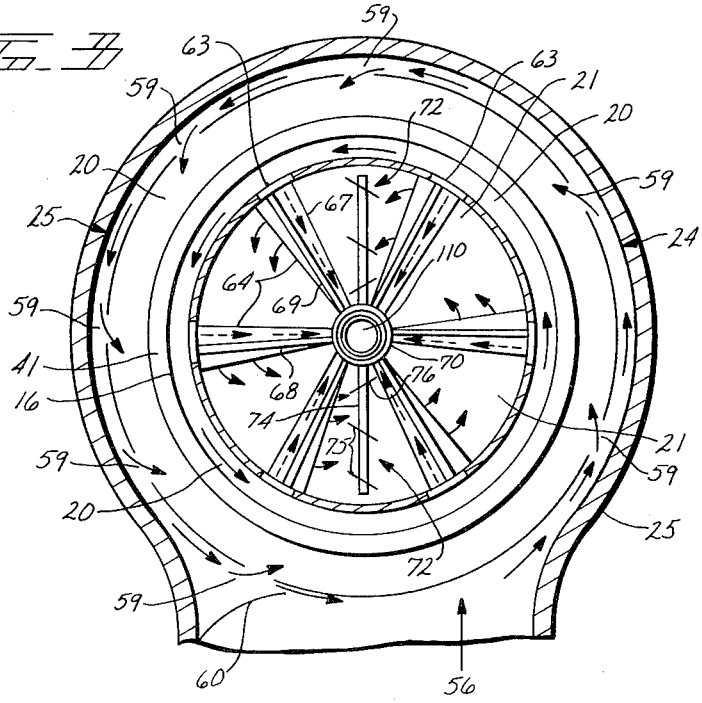
FIG. 3 is a plan view of the drying tank taken along lines 3—3 in FIG. 1.

In the presently preferred embodiment of the invention, illustrated in FIGS. 1–3, a slurry dryer tank 15 has an outer wall 16 and a horizontal floor 17. An annular baffle 18 extends upwardly from just above the floor to the upper edge of the wall. A gas manifold 20 is formed between the baffle and the wall. The gas manifold opens under the baffle into a drying space 21 in the central portion of the tank. A seal 24 around the tank at the top of the upright wall closes the upper end of the gas manifold.

The baffle continues above the gas manifold into a side wall 29 to enclose the drying space. In FIG. 1, the side wall includes a middle section 30 and an upper section 31. The middle section is secured to the baffle by conventional methods, preferably by welding together flanges 35 and 36 which sandwich a gasket material 34. A series of fasteners 38 reinforces the joint. Preferably the upper and middle sections are removably interconnected by annular flanges 137 and fasteners 138. The tank includes a top 19 which is connected to upper section 31 to close the upper end of the drying space.

A hub 22 is located in a central portion of the dryer. The hub is an annular sleeve which extends both above and below the floor. A row of sprockets 23 around the bottom of the hub receives a chain (not shown) coupled to hydraulic supply unit 90 and powwer unit 91, shown in FIGS. 9 and 10, to rotatably drive the hub. Preferably the hub is secured to the floor so that the hub, when driven, causes the floor to rotate and is concentric with the floor's axis of rotation. Preferably, the wall 16 is cylindrical and is integrally formed with the floor to also rotate, while the baffle does not rotate.

Figure 4:
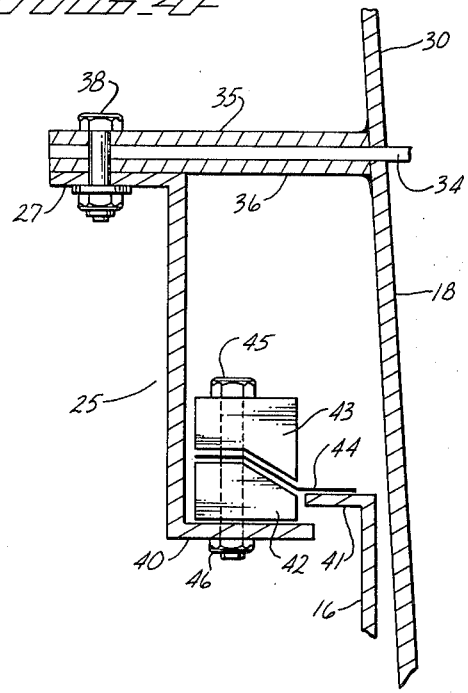
FIG. 4 is an enlarged side elevation of the rotary seal of the dryer taken around arrows 4 in FIG. 1.

The seal 24 is best seen in plan view in FIG. 3 and in enlarged side view in FIG. 4. A rotary seal shroud 25 around the tank forms the gas manifold at the top of the baffle. For clarity, the illustration of the tank in FIG. 2 is cut off below the rotary seal shroud. An outwardly extending annular flange 27 at the upper edge of the shroud is fastened to flange 36 of the baffle-side wall assembly. This connection is also secured by fasteners 38.

The lower edge of the shroud is formed by an inwardly depending annular bearing support line flange 40. The top of the rotating wall includes an outwardly extending annular lip 41. A holder block assembly provides a gastight rotary seal between flange 40 and lip 41. Fasteners 45 and 46 secure a pair of holder blocks 42 and 43 to flange 40. The blocks have complementary surfaces for engaging a sealing flap 44. The surfaces taper downwardly and inwardly to place a mild tension on the flap which presses against the rotating lip. Gas pressure inside the gas manifold also presses the flap against the rotating lip below it.

The seal holder blocks and the flap extend around the gas manifold. The sealing flap is made from a thin, flexible, heat-resistant material, preferably beryllium copper shim stock of about 0.005 inch thickness. Other materials which can resist the elevated temperatures of a fluidizing gas, preferably pulsating hot gas from a pulse jet engine exhaust, are well known to those skilled in the art and can be used for the rotary seal flap.

A support frame 52, seen in FIG. 8, supports the side wall-baffle assembly by connecting with fasteners 38 at the top of the rotary seal shroud. Thrust bearings 53 abutting the hub on a support sleeve 54 provide support for the hub-floor-outer wall assembly.

The rotary seal shroud 25 interfaces a low gas inlet transfer pipe 56, as shown in FIGS. 3 and 9. This pipe ducts pulsating hot gas and sonic energy from the pulse jet heater/blower package 57. A vane 60 on one side of the interface directs the incoming gas around the shroud. From there the gas enters the gas manifold through a series of tangential vents 59. The tangential entry causes the gas to flow in a swirling motion down the gas manifold in a direction cocurrent with the floor motion. The gas manifold distributes the incoming pulsating hot gas and sonic energy waves around the floor periphery and directs them into the drying space through an opening 61 above the edge of the floor.

The tank includes at least one and preferably a plurality of gas-ducting blades 64 adjacent the floor 17. The ducting blades are preferably non-rotatable. In FIGS. 1 and 2, the blades extend inwardly from welded junctures 63 at the bottom of the non-rotating baffle. The inner ends of the blades are attached to a collar 70, which is concentric with and spaced closely to the rotating hub 22. Preferably the collar does not rotate. As viewed from above, as in FIG. 3, the blades extend radially from the collar to the baffle. There are from one to twelve blades distributed around the floor's axis of rotation. In the presently preferred embodiment, six radial blades are uniformly distributed around the collar.

At the lower end of the gas manifold the wall includes a concave lip 62 to help direct the fluidizing gas through opening 61 under the baffle into the drying space. A thin annulus 65 at the bottom of the baffle extends slightly into the drying space to help direct the gases under the baffle and to strengthen the blade-baffle juncture. The annulus also helps keep material from entering the gas manifold.

The floor is solid and has its outer edge under the baffle and a central area surrounding the hub. The overall flow of gas and sonic energy is from the edge of the floor toward the central hub. The blades provide a path of low resistance for the gas to enter along the floor and penetrate to the center of the bed. Most of the gas flows under ducting blades 64. Gas pressure around the rest of the baffle sweeps the gas manifold clear of particles.

The pulsating hot gas enters along the floor to maximize energy transfer into the bed. The ducting blades direct the gas and serve as places of generation of rising gas streams. The hot gas mixes into the bed and fluidizes the material.

Each ducting blade is inclined in the direction of relative rotation of the floor to provide a leading edge 67 and a raised trailing edge 68 located further above the floor than is the leading edge. The leading edge directs the incoming gases under the bed.

The leading edge is sufficiently close to the floor to sweep material off the moving floor and pass the material along the top of the blades over the trailing edge. Preferably the lowest part of the blade is no more than one eighth inch above the floor. As the floor rotates, the bed slides over the blades and shears. Streams of pulsating hot gas and sonic energy are generated upward from under the trailing edge and contact particles to fluidize the bed. The slope of the blades also directs the gas streams to circulate cocurrently with the floor motion.

To improve the distribution of gas through the bed, the blade preferably includes a tapered skirt 69 depending from the trailing edge at an angle toward the floor. The skirt is widest at its closest approach to the floor near the baffle, tapers along the blade, and narrows to a point at the collar. In the presently preferred embodiment, the skirt depends at an angle of about 30° to the floor. The skirt restricts dissipation of gas near the baffle to get a more even distribution along the blade in the radial direction.

The movement of the floor tends to cause continual relative motion between the bed material and the floor upon which it rests. This motion provides an abrasive effect which scours the floor clean. The directed flow of hot gas and sonic waves scour that portion of the floor located under the blades. The dryer floor is therefore self-cleaning. The pitch of the blades suffices to lift and shear the material from the floor, yet the blades are sufficiently flat to avoid pileup of material in front of the blades. The leading edge forms an included angle from about 15° to about 45°, preferably about 30°, with the floor. Particles on the floor are repeatedly exposed to the gas by riding up and over the blades into the gas streams.

By introducing gas over a solid floor, the invention avoids the limitations associated with a perforated grid. A relatively small number of ducting blades direct the gas into the bed. Relative motion between the bed and the ducting blades exposes all particles to the fluidizing gas.

The vertically rising streams of pulsating hot gas agitate and suspend the particles into a state of fluidization. Air surrounds each particle with a relatively high velocity between the air and the particles.

The term fluid, as used here, means that fluidized solids display many properties characteristic of a liquid. Such solids flow, seek levels, and have a gas-to-liquid relationship. Rapid heat transfer occurs by a combination of conduction and convection. Temperature throughout the bed is substantially uniform. The gas leaving the bed, as well as material discharged from it, are at substantially the same temperature as the bed material. In the embodiment of FIGS. 1 and 2, the air temperature entering the drying space is on the order of from around 300° F. to around 500° F., and preferably from around 500° F. to around 700° F., while the temperature in the bed, and in the drying space above it also, is from around 130° F. to around 210° F., and preferably from around 155° F. to around 175° F.

In the presently preferred embodiment there is relative motion between the particles and the blades which shear the bed and duct the gas to generate fluidizing streams. Preferably the motion is generated by rotating the floor relative to the blades. Floor rotation causes the motion relative to the particles to vary in the radial direction. Moreover, materials do not have time to stick to the floor before intercepting the blades and fluidizing with the hot pulsating gas streams.

In their preferred form, the blades extend radially from the collar to the baffle. Floor rotation is always tangential or perpendicular to these blades, which maximizes relative motion between particles carried on the floor and the blades which intercept and shear this material. Gas mixing into the bed is optimized by this geometry. Moreover, radial blades provide the most direct path for gas, which enters along the edge of the floor, to penetrate into the central region of the drying space. Although the temperature and pressure of the gas decrease along the blades as the gas streams mix into the bed, the gas velocity tends to increase, because the cross sectional area of a radial blade decreases toward the central hub. This geometrically imposed velocity effect increases heat penetration into the inner regions of the bed, which tends to balance temperature and pressure reductions from generation of gas streams along the blades. Thus, the distribution of gas and sonic energy is adequate to fluidize the entire bed.

There are other important advantages gained by rotating the floor. Since the floor is solid, it rotates at a uniform angular velocity w relative to the blades. However, objects on the floor at varying distances from the central hub do not move at a uniform speed. Any given spot on a rotating floor has a velocity r·w, where r is the distance from the axis of rotation, which is at the center of the floor. To an approximation, objects on the floor revolve around the central hub with a tangential velocity r·w. Near the baffle, r is large, as is the speed of the particles relative to the blades. Conversely, near the collar, r is small, and the relative motion of the particles (and their potential for mixing with gas streams) is minimized. In a given period of time, by introducing the gas and sonic energy from the outer edge of the floor, the hottest gas streams, which have the greatest potential for burning or scorching the bed material, contact the fastest particles. The hottest gas also contacts the greatest concentration of particles, since the cross sectional area of the floor increases in the radial direction away from the floor center. The greatest heat transfer occurs where the tangential velocity of the particles and their potential for mixing is greatest. The gas flow complements the geometry of the dryer.

In the presently preferred embodiment, illustrated in FIG. 2, the incoming gases flow under the blades, but not under the collar. The top and the bottom of the collar are rotatably sealed to the hub by a rotary slip gasket 71 to keep material out of the space between the collar and the hub.

To increase the exposure of particles to the gas streams, there is at least one stirring arm 72 located above the ducting blades 64. In FIG. 2, there are two stirring arms evenly distributed about the floor's axis of rotation, although any number up to about twelve can be provided. The stirring arms are attached to a ring 73 around the hub for rotation cocurrent with the floor. The ring is rigidly fastened to and driven by the hub. Each stirring arm extends proximate to the baffle and includes a stiff arm 74 carrying a plurality of paddles 75.

The paddles are preferably made from a flat plate of stiff material. They are transversely mounted to the arm and preferably tilt outwardly in their direction of motion to scoop material toward the center of the bed. Their outboard leading edge preferably defines an obtuse angle with the radial arm. However, an innermost paddle 76 tilts in the opposite sense to urge material away from the area near the hub and has an inboard leading edge defining an acute angle with the radial arm. Preferably there are two or three outer paddles and an innermost paddle 76 on each arm, although a different number may be provided as needed to stir the bed.

The paddles extend vertically below the plane of the arm and sweep closely above the stationary ducting blades as the floor and the stirring arms rotate. The paddles stir the bed and generate relative motion between the material and the streams of hot gas. The stirring further varies the exposure of individual particles and helps assure that all particles will from time to time contact a gas stream. Moreover, the stirring rapidly closes off any weak spots that may develop in the bed. The innermost paddle urges material away from the hub where the potential for mixing is small.

It is preferred to place a bed of grinding media 78 on the floor before introducing fresh material into the dryer. The grinding media cover the ducting blades and preferably form a bed which is at least twice as deep as the ducting blades, and which is sufficiently high so that it is agitated by the paddles. The lower part of the bed, six inches to a foot deep, is always in motion. For drying very sticky slurries, it is preferred that the grinding media occupy the greater part of the volume of the fluidized bed.

The media grind the slurry and help disperse it around the bed. This tends to keep sticky materials from gluing together or otherwise resisting fluidization. The grinding cooperates with the stirring by the paddles to increase the exposure of particles to the upwardly flowing pulsating hot gas and sonic energy. The media also help keep the fluidized bed in an essentially dry condition as moist particles are introduced. Inert grinding media are well known to those skilled in the art, and presently a dry abrasive round or oblong material, such as ball mill or olive or date pits, are preferred.

The incoming gases flow inwardly from the edge of the floor toward the hub. They also swirl cocurrently with the floor motion due to the tangential entry into the gas manifold and the sloping of the blades. The gases entering the drying space have both radial and tangential components of motion. The gas flow, along with shearing of the bed over the ducting blades, causes a waving and spiraling of the fluidized bed. This motion helps expose all the particles to the gas streams and rapidly closes up any weak spots that may develop in the bed. This in turn substantially eliminates geysering or gas eruptions through the bed.

The fluidizing gas is preferably provided by a pulse jet engine which transmits heat, air movement, and a wide spectrum of sonic energy waves to the slurry dryer. The pulse jet heater and blower package 57, shown in FIG. 8, houses the pulse jet engine 80, which pumps pulses of hot gas and sonic energy waves through augmentors 81 and 82 into low gas inlet transfer pipe 56 and high gas inlet transfer pipe 55. A description of pulse jet engines of the type used herein, entitled "Pulse Reactor Low Cost Lift Propulsion Engines", dated May 1964, by R. M. Lockwood, AIAA paper Number 64–172, is available from the American Institute of Aeronautics and Astronautics, 1290 Sixth Avenue, New York 10009.

In FIG. 6, the pulse jet engine includes a combustion chamber 83 and a pair of exhausts, which are the inlet 84 and the tailpipe 85. A passageway in the combustion chamber receives air/fuel mixtures. A spark plug ignites the initial mixture. When combustion occurs, increased pressure forces hot gas out from both ends of the combustor, that is, from the inlet as well as from the tailpipe. Over-expansion causes a relative vacuum in the combustion chamber, which draws oxygen-containing gas to support combustion from the atmosphere surrounding the inlet and hot gas from the tailpipe. The hot gas ignites a new air/fuel mixture to produce multiple points of ignition, and further combustion and expansion. The cycle proceeds indefinitely without moving parts.

The augmentors 81 and 82 have no internal parts, yet significantly increase the thrust from the engine exhausts. Each augmentor draws gas from its surrounding atmosphere into a pulsing exhaust stream. In a preferred operation, tailpipe 85 and augmentor 82 pump approximately sixty percent of the pulsating energy to low gas inlet transfer pipe 56, while the inlet 84 and augmentor 81 pump the remainder to high gas inlet transfer pipe 55.

Fuel tank 87 supplies fuel for the pulse jet engine, which preferably consumes propane, although pulse jet combustors are relatively insensitive to the particular fuel used and will operate on a wide variety of air-reacting fuels, preferably, for example, gasoline, fuel-oils, and butane.

To improve drying characteristics of perishable products, the air in the system preferably recycles, which progressively consumes its oxygen. Air intake 88 and blower 89 supercharge the inlet end of the pulse jet engine to increase the oxygen content of the feed air sufficiently to support continuous combustion. The supercharging also increases the rate of gas flow into the dryer.

The broad-band sonic waves produced by the pulse jet engine are composed of compression waves closely coupled with rarefaction waves. The sonic energy efficiently and rapidly removes the moisture-laden boundary layer surrounding each drying particle. The rate of drying with sonic energy can be an order of magnitude or more faster than with conventional drying systems.

It is believed that the broad-band sonic energy waves vibrate the particles at their natural frequencies. A mechanical response to the "push-pull" effect of the compression-vacuum waves causes a rapid flow of moisture to the particle surface. In other words, a massaging action accelerates the flow of internal moisture to the surface of each particle. At the surface, the broad-band sonic energy waves scrub away the boundary layer of moisture-laden air at a rate which exceeds the rate at which moisture ordinarily diffuses to the surface from the interior of the particle. The acoustic energy from pulsating combustion increases the rate of moisture removal from the particles.

The pulse jet engine is economical because it converts a high proportion of the potential energy present in fuels into heat, into borad-band sonics, and into air movement. The pulsations further vary the exposure of individual particles by causing the bed to lift and drop at irregular intervals. The simplicity of the pulse jet combustors is a further economic advantage. The cost of maintenance is low, because these engines and their augmentors 81 and 82 have no moving parts.

The new dryer will also operate with a conventional steady hot gas source. However, the pulse jet engine increases the rate of drying by a factor of 2 to 10 or more, because it provides acoustical energy and pumps hot pulsating gases to heave the bed.

Figure 5:
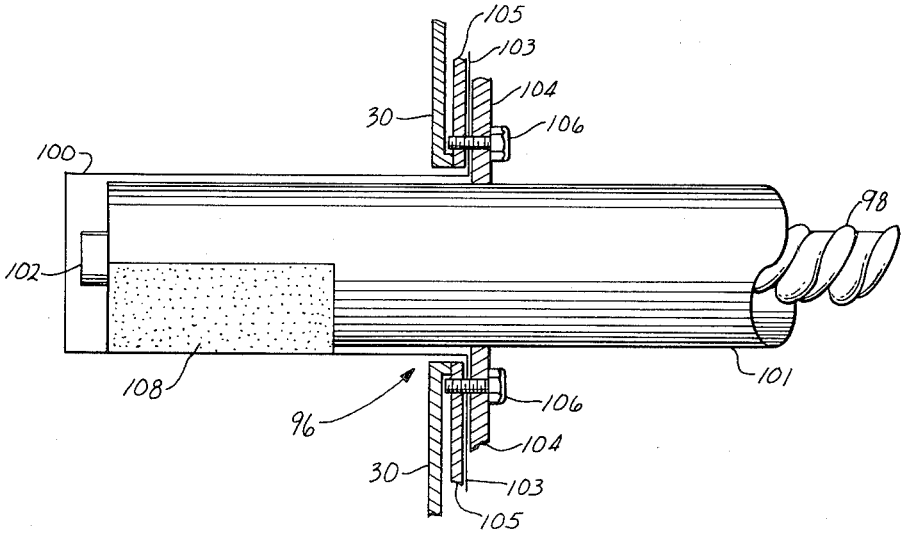
FIG. 5 is an enlarged side elevation of the particle inlet for the dryer taken around arrows 5 in FIG. 1.

The moist particles or slurry continuously enter the tank 15 above the blades to form a bed of particles through a radial inlet 96 in the side wall, seen in FIGS. 2 and 5. A slurry pump 97, preferably a bump pump, drives a screw conveyor 98 which feeds from a hopper 99. The particles drop into an outer region of the fluidized bed near the baffle, preferably at a slow rate, and distribute about the bed as the floor rotates.

Preferably the new material enters at such a rate that the moist particles drop into a substantially dry bed. The preferred operating technique requires that the bed be essentially dry and that the wet material be carefully fed into the bed. If wet or sticky material enters too rapidly, it could lump together or form a paste. However, this tendency can be substantially reduced by incorporating stirring arms in the dryer to spread the fresh material around the bed. The feed rate of the slurry can be several times greater when the stirring arms previously described are used.

The particle inlet comprises a sleeve 100 for receiving a screw auger tube 101, which houses screw conveyor 98 which terminates in a journal 102. The sleeve removably attaches to the middle side wall section 30 by a flange 103, which is held in place between a reinforcing flange 104 carried by screw auger tube 101 and by a tubular extension 105 of the side wall at inlet 96. Removable fasteners 106, such as bolts or the like, secure the inlet assembly.

A screen 108 along the lower inner edge of the sleeve extrudes the slurry as it enters the drying space. The arrangement illustrated in FIG. 5 provides a particle inlet which quickly and readily disassembles for servicing or, for example, for replacing the screen, preferably having a 3/16-inch or ¼-inch mesh, with a screen of different mesh for processing moist particles of larger or smaller dimensions. Those skilled in the art will appreciate, however, that feed mechanisms other than screw conveyors may be used to introduce the slurry into the bed.

The moist particles drop into an outer region of the bed near the baffle. This improves heat transfer, since the wet-test and coolest particles enter the bed in the region where the gases are hottest. These particles sink toward the floor and contact upwardly flowing streams of fluidizing gas. The heated particles rise, lose moisture and cool, and sink to contact another stream of fluidizing gas, whereupon the process of changing particle exposure continues.

When a bed of grinding media 78 is provided on the floor, the moist particles are ground and tend to separate from each other as they work their way into the fluidized bed. The grinding media help keep the fluidized bed in an essentially dry condition as moist particles are added to the bed. The particles are rapidly dried and eventually work their way to the top of the fluidized bed and spiral toward the hub.

The rotating stirring arms 72 above the ducting blades 64 also spread the moist particles around the bed. This improves fluidization by preventing moist material, which is relatively heavy, from piling up or forming a paste under the radial inlet or at some location downstream. The stirring arms also improve fluidization by scooping the particles past the gas streams.

The hub keeps the bed from forming inside that part of the tank where a small magnitude of tangential floor, paddle, and relative particle motion reduce the potential for mixing. Fluidization could otherwise break down in that region, since particles in the very center of a bed without a hub might not be adequately exposed to the gas streams. However, the dryer utilizes the space inside the hub as a central discharge 110 for withdrawing heavy and coarser particles from the drying space through the floor. When a particle reaches the region of lowest mixing potential (i.e., the top of the bed next to the hub), it can leave the bed through the discharge.

A pair of closely-spaced concentric upright annular sleeves 112 and 113 serve as the discharge and the central hub. The central hub or outer sleeve 112 is attached to and drives the floor. The discharge or inner sleeve 113 may slide relative to the hub and preferably does not rotate. Sleeve 113 depends beneath the floor and connects to a support sleeve 54 and a collection bin 115 underneath the tank. The discharge 110 functions as an overflow drain for removing heavy and preferably dried products from the fluidized bed. As a drain, the discharge pulls in material which helps induce a spiral motion at the top of the bed.

There is a rotary valve arrangement 116 and a plug 118 defined along the bottom of the discharge shaft. The rotary valve is preferably any conventional star valve which is capable of passing particles through to the plug without a significant change in the air pressure on either side of the valve. When the plug is open, product passes through to collection bin 115. Product collected in the bin may, if desired, be returned to the screw conveyor hopper for further processing by extrusion, through a replacement screen 108 having a greater mesh, into the dryer.

A star valve is preferred because the ambient pressure inside the drying space during operation is greater than atmospheric pressure. To open the plug without such a valve would cause the pressure to drop suddenly across the discharge sleeve. This in turn would tend to cause a large volume of particles, which might be incompletely dried, to leave the fluidized bed and travel down the sleeve.

In another preferred embodiment, the inner sleeve 113 is omitted, and central hub 22, which is an annular sleeve, serves also as the central discharge. For this embodiment, the hub and floor are supported by thrust bearings 53 on support sleeve 54 mounted on bin 115.

The pulse jet inlet 84 also pumps hot gas and sonic energy to the dryer tank through a high gas inlet transfer pipe 55 which is shown in FIG. 9. An auxiliary gas inlet shroud 120 connects tangentially to the middle side wall section 30, preferably above particle inlet 96 and the rotary seal shroud. Preferably the top of the auxiliary gas inlet shroud attaches below the flanges joining the middle and upper sections of the side wall.

Pulsating hot gas and sonic energy enter the drying space on a tangent through the auxiliary inlet and circulate cocurrently with the rotating floor. There is a gas outlet 122 in the top 19 of the tank, which is preferably centered directly above central discharge 110. The top also contains a particle outlet 124 which is offset from the gas outlet.

A pair of cyclone support plates 126 and 127 extend proximately above and proximately below, respectively, the central discharge and the gas outlet. The support plates are horizontal, preferably circular in cross section and vertically aligned. They support a cyclonic or anticyclonic swirling motion of gases in the drying space above the bed cocurrent with the relative motion at the floor as long as gas is pumped under pressure into the auxiliary inlet, and gas is withdrawn from outlet 122 above the upper support plate. Since the fluidized bed is ordinarily at greater-than-atmospheric pressure, there is a pressure drop near the top of the tank, which is closer to atmospheric pressure. Gases normally follow the pressure gradient and flow to the top of the tank and out the outlets.

The offset outlet 124 is preferably located in the top of the tank. Alternately, this outlet may be located on the side wall, preferably near the top, to collect particles and reduce the pressure gradient required for extraction from the dryer.

The annular sleeve functions in both the fluidized bed and in the gas swirl. The central hub aids fluidization by closing off a space of low mixing potential which is used as an overflow drain. The same structure helps generate the gas swirl without interfering with the fluidized bed by providing a foundation for attaching the lower cyclone support plate.

The dryer exploits the entire volume of the drying space. Particles entering the swirl are further dried by exposure to sonic energy and pulsating swirling gas. Each region feeds from its own source which takes advantage of both exhaust pipes of the pulse jet engine. The greater volume exhaust from the tailpipe 85 feeds the gas manifold to fluidize the bed, while the lesser volume exhaust from the inlet 84 feeds the auxiliary inlet to generate the swirl.

As a particle is dried, its density decreases, and the particle works its way to the top of the fluidized bed, where, if the bed is operated as high as the lower support plate, the swirl entrains the finer particles for further drying by exposure to sonic energy and pulsating swirling gas. Alternately, and if the bed is not as high as the central hub, some particles eventually contact a stream of pulsating hot gas and accelerate through a momentary weak spot in the bed into the swirl.

The swirl agitates the top of the fluidized bed to cause it to spiral toward the hub. Such a spiral motion helps mix the bed and increases processing time to improve moisture removal. Preferably the particle motion, viewed from above the bed, follows or approximates a Spiral of Archimedes. Consequently, the rate of relative rotation at the floor, which is adjustable, is not too rapid to avoid throwing the bed against the baffle. On the other hand, the floor rotates sufficiently to cause shearing of the bed as it intercepts the blades. The floor preferably rotates slowly from about five to about fifteen times a minute.

The flow of gas through the auxiliary inlet preferably has sufficient strength to cause a vortex to form above the bed. By creating a powerful vortex in the dryer, finer particles separate from heavier and coarser materials in the fluidized bed without requiring structure that would interfere with fluidization. A vortex further dries the finer particles which might, if the dryer were operated with a bed higher than the hub, otherwise go down the central discharge drain in an incompletely processed condition and require further separation from dried heavy particles.

Vortex gas carrying particles follows the pressure gradient from the bed to the top of the tank, where, due to centrifugal effects inherent to vortex acceleration, the moisture removed from the particles is carried toward the central outlet separated from the denser particles which swirl near the side wall. A stream of moist gas is withdrawn through central outlet 122, and a stream of gas carrying the dried fine particles is withdrawn through offset outlet 124.

The vortex preferably has sufficient strength to centrifugally separate removed moisture and fine particles into two distinct streams. The particle-free moist gas from the central outlet enters a recycle stream 130 for return to the tailpipe end of the heater/blower package. In the recycle stream there is a moisture removal device 129, for example, a conventional refrigeration unit. However, other devices or methods for moisture removal can be used and are well known to those skilled in the art, such as, for example, discharging a proportion of the moisture-laden gas to atmosphere. The gas undergoes moisture removal and recycles by way of pipes 130 to the atmosphere at the tailpipe end of pulse jet heater/blower package 57, which preferably includes an annular diaphragm 150 attached around the tailpipe and a tailpipe blower 151 supercharging the pulse jet tailpipe exhaust.

The diaphragm divides the volume of the pulse jet heater/blower package into two separate atmospheres. The pulse jet engine is insensitive to the oxygen content of the atmosphere at the tailpipe end, since the tailpipe end merely provides heat while the oxygen needed for combustion is drawn in through the inlet exhaust pipe. The atmosphere at the inlet end is supercharged by blower 89 to provide sufficient oxygen to support continuous combustion. The diaphragm keeps the supercharged atmosphere at the inlet end from feeding tailpipe 85 or its augmentor 82. The recycle streams 130 and 181 feed reduced oxygen content gas to the atmosphere at the tailpipe end of the pulse jet heater/blower package, preferably into the operating area of augmentor 82. The recycle gas enters the pulsating tailpipe exhaust stream and is pumped to the gas manifold.

The atmosphere at the inlet exhaust end is kept separate from the atmosphere at the tailpipe exhaust end. The supercharged oxygen content inlet atmosphere does not pass through diaphragm 150. However, this gas can communicate with the tailpipe atmosphere by first undergoing combustion in the pulse jet engine and passing out the tailpipe exhaust or by entering the tailpipe atmosphere as recycle gas.

Recycling the dewatered and deoxygenated stack gases improves the characteristics of many food products, because fluidization occurs in an inert or oxygen-depleted atmosphere, which retards undesirable enzymatic activity. Recycling also saves volatile aromatics or other flavoring ingredients in the finished product.

Figure 10:
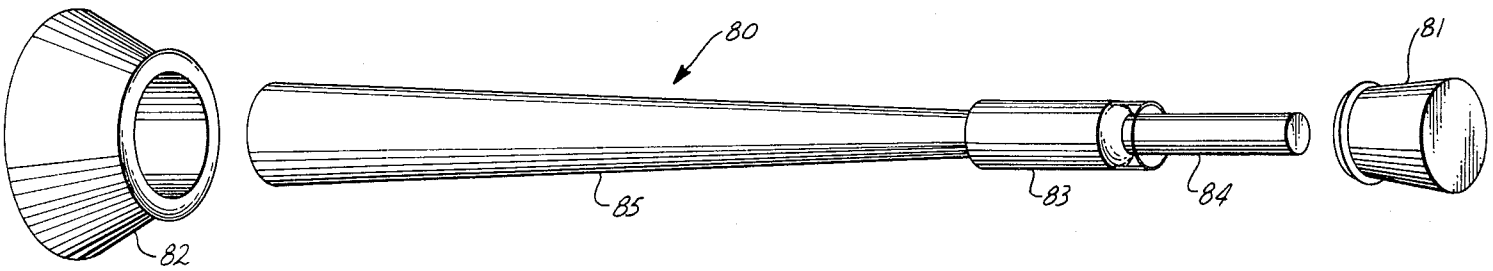
FIG. 10 is a perspective of the portable slurry dryer system.

The other particle-laden stream leaving the dryer through offset outlet 124 flows through conduit 132 to a pair of conventional cyclone separators 134, shown in FIGS. 8–10, which separate the particles from the gas. A conveyor 135 receives the fine product from underneath the cyclone separators and carries the product to a collection bin 136.

The exhaust gases from the cyclone separators are preferably collected in outlets 180 and enter a recycle stream 181. In this recycle stream there is a moisture-removal device, which may be similar to the device used in the other recycle stream 130. In the presently preferred embodiment, a valve 182 permits discharge of an adjustable portion of the stack gas to the atmosphere. The gas remaining in recycle stream 181 is conducted to the tailpipe end of the pulse jet heater/blower package for return to the gas manifold.

To improve control of the strength of the gas swirl, the dryer preferably includes a conventional damper valve installed in the high gas inlet transfer pipe 55 where it interfaces the auxiliary gas inlet. The damper valve is capable of directing the gas to flow either to the auxiliary inlet or through a shunt 153 to the low gas transfer pipe 56 at its interface to the rotary seal shroud 25.

The damper valve and shunt permit adjustment of the relative proportions of pulsating hot gas and sonic energy entering the gas manifold and the auxiliary gas inlet. The supply to the auxiliary inlet may be diverted entirely or partially or not at all to the rotary seal shroud to augment the pressure of the gas fluidizing the bed. The flow through the shunt is always from the high gas to the low gas inlet transfer pipe, because the pulse jet inlet pipe 84, although it pumps a smaller volume of gas, pumps against a higher back pressure than does the tailpipe 85. Partial diversion of gas is preferably practiced to augment the fluidizing pressure, while retaining a significant, although diminished, pressure to generate a swirl above the fluidized bed.

The swirl can be adjusted from a powerful vortex to a gentle wisp. When the gas is diverted entirely, there is at most a gentle wisp above the fluidized bed. In this mode of operation, the swirl does not have sufficient strength to appreciably increase the residence time of entrained particles. However, the fluidizing pressure is augmented, and there is a significant pressure gradient running from the floor to the top of the tank, since the cyclone separators operate at or near atmospheric pressure. Particles carried by the gas are not delayed by getting caught in a swirling motion. The gas follows the gradient directly up through outlets 122 and 124 and carries particles from the dryer.

Preferably central outlet 122 is coupled to a conventional diverter valve for selectively directing flow to either recycle stream 130 or to conduit 132. When the damper valve is positioned to provide a powerful vortex, that is, a swirl powerful enough to effect centrifugal separation of gas into a stream carrying moisture and a stream carrying particles, the diverter valve is set to send moist particle-free gas to recycling stream pipes 130 and its moisture remover. On the other hand, when the damper valve is set to shunt a sufficient proportion of the gas to fluidize the bed so that there is not enough gas pressure at the auxiliary inlet to support a vortex, or effect centrifugal separation of fine particles from moisture into separate airstreams, the diverter valve is adjusted to route the stack gas from centered outlet 122 through conduit 132 to the cyclone separators for removing particles before reycling the gas stream.

The diaphragm and damper valve system, along with the diverter valve, increases the versatility of the dryer. By selectively shunting gas to the gas manifold, the drying conditions can be varied. For example, the fluidizing pressure can be increased for accomodating relatively sticky materials. The ambient pressure gradient from the fluidized bed to the top of the tank causes stack gas to escape through gas outlets 122 and 124. Swirling of particles above the fluidized bed tends to reduce the ability of the gas to carry particles to the outlets. The stronger the swirl, the longer the particles circulate exposed to the sonic waves and drying gas. By adjusting the relative proportion of gas entering the dryer through the gas manifold and the auxiliary gas inlet, the swirl strength is selected to control the tendency of particles to escape with the gas, which determines drying times. For operations drying only fine particles, it is preferable to operate with a slight swirl, or none at all. On the other hand, for drying a mixture of heavy and light particles, a moderate to heavy swirl (or a vortex) is preferred. Heavier particles are caught longer in the swirl and are processed longer than lighter material.

The baffle preferably expands radially from a minimum diameter at the blade juncture to a maximum diameter at the top of the gas manifold. Such a baffle improves fluidization by causing radial expansion of the bed as it heaves in response to the intermittent pulsing of the fluidizing gas. The radial expansion slows particle motion and increases retention and drying time. This improves the characteristics of the finished product, because sufficient retention time ensures that occluded moisture trapped inside the particle will be removed. Expansion also improves elutriation of fine particles in the bed from both the heavier and the moister ones. Thus, the slurry dryer can classify finer materials from heavier ones. Moreover, the exposure of heavier materials in the bed to the fluidizing gas changes at a different rate from that of the lighter particles.

Preferably the middle section 30 of the side wall continues the radial expansion above the baffle. A swirling particle will then slow down as it rises in rough proportion to its size. The finer particles come out relatively quickly. The heavier particles are processed longer as are larger particles having a low drag coefficient. Expansion, practiced in conjunction with adjustable strength swirling, improves control of drying time and uniformity of finished product.

For versatility, the dryer is provided with several different interchangeable upper side wall sections. The upper and middle sections preferably are removably joined by annular flanges 137, which provide an airtight seal when secured by fasteners 138. This construction permits easy and quick disassembly of the side wall for cleaning the tank, or for adding or removing grinding media, or for changing the upper section.

In one presently preferred embodiment, shown in FIG. 1, the side wall tapers from the bottom of the upper section 31 to the top 19 of the tank. Wall tapering causes radial contraction and a corresponding increase in the velocity of particles carried by that portion of the swirl or vortex. Since the heavier particles contain more moisture and are denser than light particles, the heavier particles tend to swirl in the radially expanding middle section 30. These particles are not carried to the tapered upper section to accelerate until they have reached an appropriate degree of dryness and are then correspondingly less dense. Consequently, heavier particles are exposed longer to the sonic waves and drying gas than are lighter particles, and moisture is removed to substantially the same degree from all particles. A tapered upper side wall section also reduces the pressure gradient needed for carrying particles through the offset outlet.

In another presently preferred embodiment, shown in FIGS. 8–10, the side wall expands radially all the way from the baffle to the top of the tank. This side wall includes an upper section 32 which continues the expansion of the baffle and middle section 30 and is preferred for drying uniformly fine or featherlike particles. A uniformly expanding side wall will dry heavier particles and mixtures of particles, but requires a greater negative pressure gradient to the top of the tank (and corresponding greater supercharging blower pressure) to carry particles through the gas outlets than does the tapered side wall discussed in connection with FIG. 1. In still another presently preferred embodiment, not shown, the tank operates without an upper side wall section 31 or 32 with the top 19 attached directly to the middle section 30.

The present invention contemplates a method of fluidization. Moist particles are introduced into a drying space having bottom and side boundaries to form a bed of particles. A fluidizing gas is introduced from a periphery of the bottom boundary. A portion of the gas is directed from the periphery into a central area of the drying space. The inwardly directed gas generates rising streams of hot gas along the bottom boundary for fluidizing particles in the bed. The streams are generated along the path of gas flow. Some of the gas penetrates to the center of the bed.

The gas streams fluidize the bed with a time average uniform exposure of the bed to the hot gas. This is accomplished by purposefully and continuously changing the exposure of particles in the bed to the streams of hot gas.

The varying exposure is preferably effected by imparting relative motion between the bed and the places of generation of the hot gas streams. In the dryer illustrated in FIG. 1, for example, the floor rotates relative to the blades 64 which direct the incoming gas, generate the fluidizing streams, and shear the bed. The rotation causes the bed to mix with the fluidizing gas and helps expose all the particles to the gas streams. Moreover, the relative motion is greater at the periphery of the drying space than in the central area near the hub. This helps generate a continuously changing exposure of particles to the fluidizing gas.

Relative motion is preferably increased further by stirring the bed; in the preferred embodiment, the stirring arms pull the bed material past the ducting blades. Stirring the bed helps assure that all particles are exposed from time to time to the fluidizing streams. Stirring also rapidly closes off any weak spots that may form in the bed.

Preferably the exposure is also continuously varied by causing the bed to lift and drop at irregular intervals. By using a pulse jet engine as the source of fluidizing gas, the gas pulsates intermittently upon entering the drying space. The bed heaves in response to the pulsations and turns over rapidly so that, on the average, all particles will mix with the fluidizing gas streams every several seconds. No particle is continuously exposed to the hot gas for a substantial length of time, not for over five seconds at any one time, and preferably not for over two seconds.

Preferably the bed is also caused to expand radially as it heaves and lifts. Radial expansion helps fluidize the bed by keeping it from clumping together. The heaving bed rises less in the vertical direction during the lifting phase than would a bed which cannot expand radially. Neither does the heaving bed pile up objectionably when it drops. Radial expansion helps expose all the particles to the gas streams.

In the preferred method, a swirl of gas having an adjustable strength circulates in the tank above the fluidized bed. The swirl is cocurrent with the relative motion at the floor.

Bed heaving, practiced with radial expansion, improves acceleration of individual light or appropriately dried particles into the gas swirl above the fluidized bed. Such particles accelerate more readily from a heaving and expanding bed on a strong pulse of gas than they would from a quiescent and continuously uniform bed using some conventional hot gas source.

Near the edge of the floor, the gases are at their hottest, but entering the drying space in the region of greatest relative motion which causes particles there to have a relatively high tangential velocity and a high rate of heat transfer. The gases contact a relatively large number of particles but with a corresponding minimal risk of scorching or burning. The exposure of particles in this region continuously changes at a rapid rate. Moreover, the moistest particles drop into the bed in this outer region. They are preferably distributed around the bed by stirring arms and initially contact some of the hottest gas streams. This further increases heat transfer. When incorporated, the grinding media tend to separate the moist particles from each other and increase their exposure to hot pulsating gas and sonic energy.

The fluidizing gas progressively loses temperature and pressure as it flows into the bed and contacts particles from under the trailing edge of the blades. In the preferred embodiment, a tapered skirt, and an increase in gas velocity from a reduction in the cross sectional area of radial blades toward the hub, balance the loss in gas temperature and pressure. The direction of gas flow complements the geometry of the dryer. The method of this invention substantially eliminates geysering or gas eruptions to enable continuous fluidization for as long as desired.

When the dryer operates with a fluidized bed which is not as high as the top of the annular sleeve or hub, particles encountering a strong upward stream of pulsating hot gas enter the space above the fluidized bed. These particles become entrained in the swirl, and the lighter ones eventually leave the dryer through an outlet at the top of the tank. The largest and the heaviest particles, however, tend to return to the fluidized bed. Eventually, if these particles were not withdrawn from the bed, the bed would propagate to occupy a greater volume than a practical gas pressure could fluidize. The central discharge sleeve operates as an overflow drain to keep the height of the bed within manageable limits.

It is apparent that dryers other than that described above can be used to practice this method of drying. For example, in place of a rotating wall formed integrally with a rotating floor, a stationary wall could be provided with an appropriate rotary seal inserted between the bottom of the wall and a separate rotary floor. A dryer could also use the method for fluidization without a swirl or vortex above the bed.

This invention also provides a method for dehydrating particles in an oxygen depleted atmosphere. A pulse jet engine is operated to generate pulsating hot gas and sonic energy which are introduced into a dryer to remove moisture from the particles. Gas containing moisture is withdrawn from the dryer and moisture is removed from this gas. The pulse jet engine has a tailpipe exhaust and an inlet exhaust. The tailpipe exhaust opens into one atmosphere. The inlet exhaust is arranged to conduct oxygen containing gas from another atmosphere at the inlet exhaust into a pulse jet combustion chamber for supporting combustion.

The moisture depleted gas is recycled to the atmosphere at the tailpipe exhaust. The atmosphere at the inlet exhaust is supercharged to provide sufficient oxygen to support further combustion. The atmosphere at the inlet exhaust is kept from feeding the tailpipe exhaust. The atmosphere at the tailpipe exhaust is kept from feeding the inlet exhaust. Dehydration then proceeds in an oxygen depleted atmosphere. The method can be used on any dryer where drying gas is supplied by a pulse jet engine.

Figure 7:
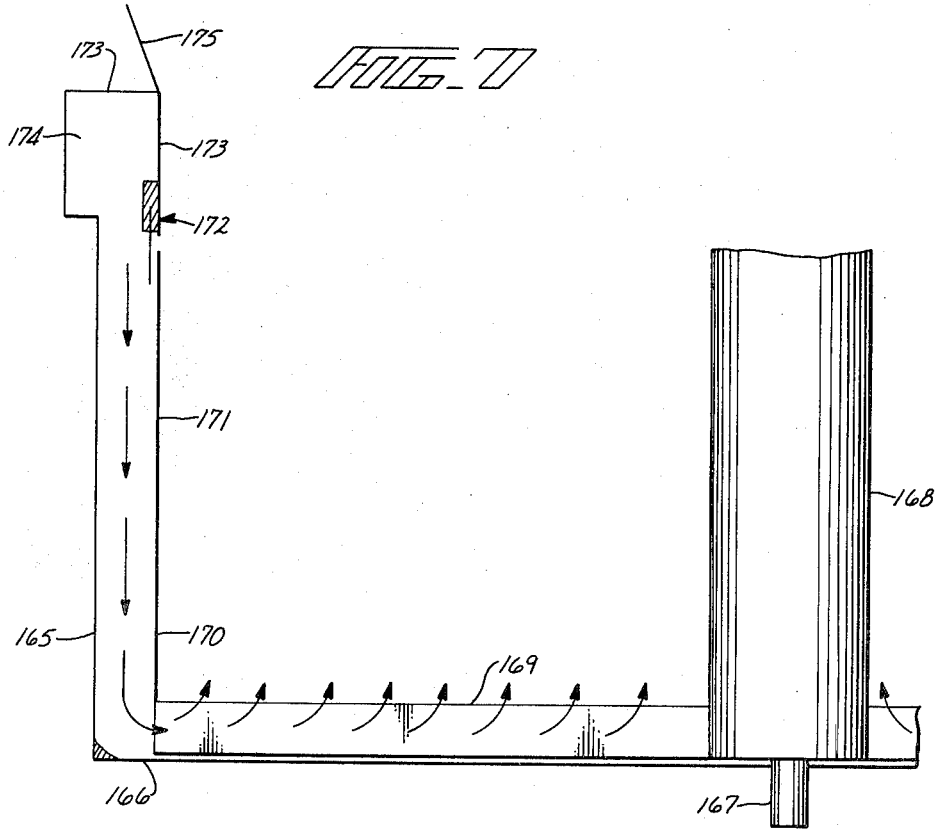
FIG. 7 is a partial side elevation of an alternate preferred drying tank.

FIG. 7 is a partial side elevation of another alternate preferred embodiment. In this dryer, a relative motion between the floor and the blades is imparted by rotating the blades and the baffle relative to the floor. A nonrotating outer wall 165 is integrally formed with a stationary floor 166. A drive shaft 167 extends through the center of the floor and drives a rotating central hub 168 above the floor.

A plurality of rotating ducting blades 169 are secured at their inner ends to the hub and sweep close to the floor. The outer ends of the blades are secured to and support the lower edge of a rotating baffle 170. A gas manifold 171 is defined between the stationary outer wall 165 and the rotating baffle. A rotary seal 172 provides an airtight seal at the top of the baffle to seal the gas manifold from the drying space. The outer wall is in communication with the low gas transfer pipe by a duct structure 173 similar to the rotary seal shroud 25 discussed previously. The duct structure defines a tangential entry hot gas duct 174 around the top of the gas manifold. A side wall 175 of the tank is attached to the duct structure 173 at the top of the outer wall.

The embodiment in FIG. 7 differs from the embodiment of FIG. 1 in that the blades and the baffle in the FIG. 7 dryer rotate relative to the floor and the outer wall, which is the reverse situation from the FIG. 1 dryer. However, the embodiment of FIG. 7 imparts relative motion between streams of hot gas, which flow from under the rotating ducting blades, and the bed of fluidized material, and operates under principles discussed previously, with the gas swirl being cocurrent with the blade rotation instead of with the floor motion.

The invention contemplates that both the floor and the blades can rotate at different speeds or in opposite directions, as either arrangement would impart relative motion between the bed and the fluidizing gas streams.

Figure 11:
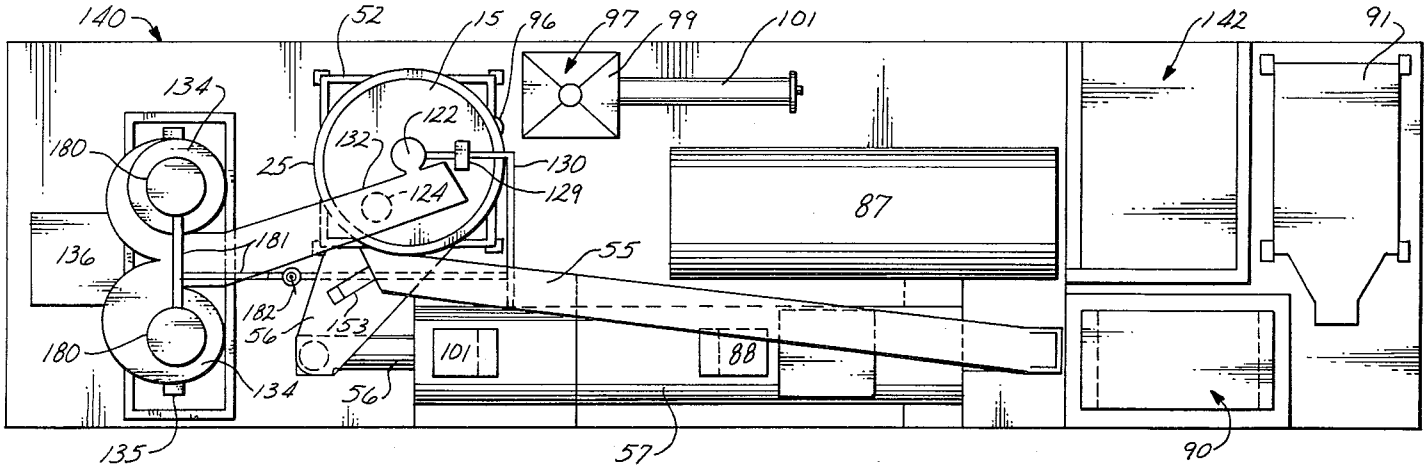
FIG. 11 is a side elevation of an alternate preferred drying tank.
Figure 4:
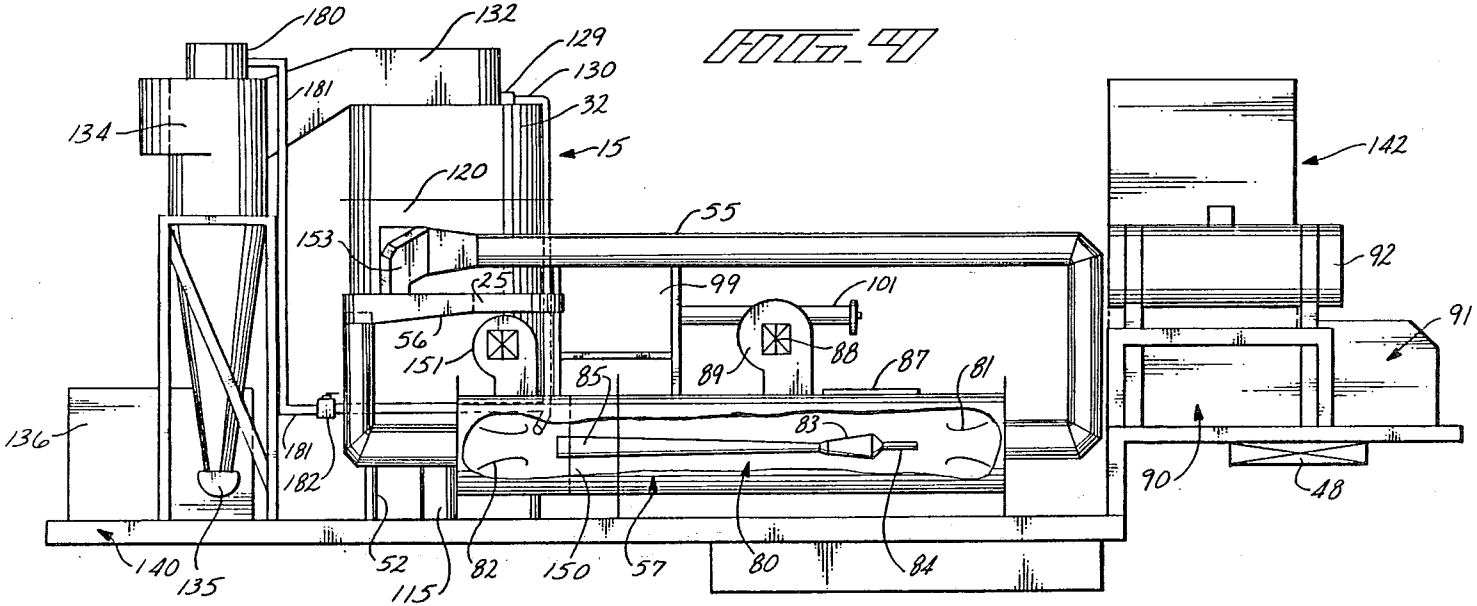
Figure 10:
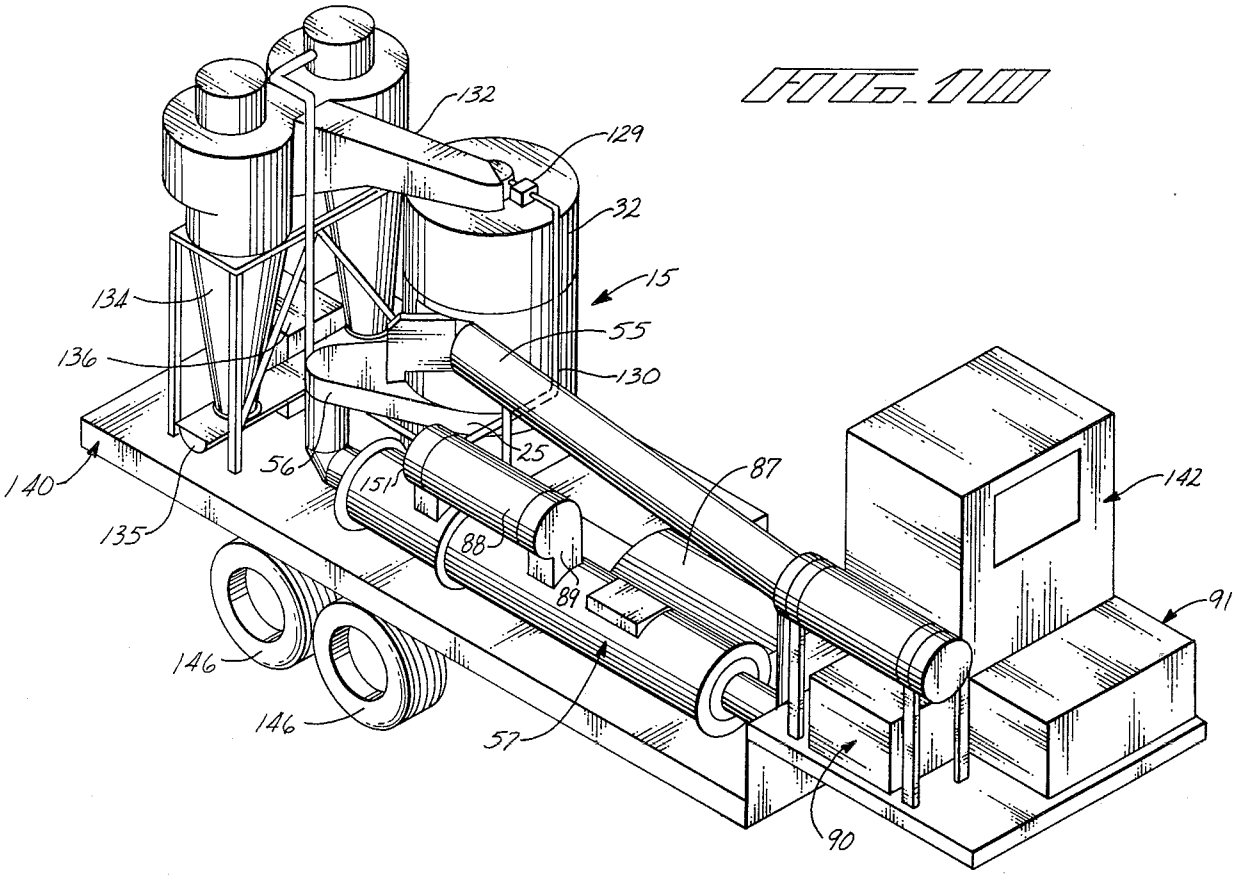
Figure 11:
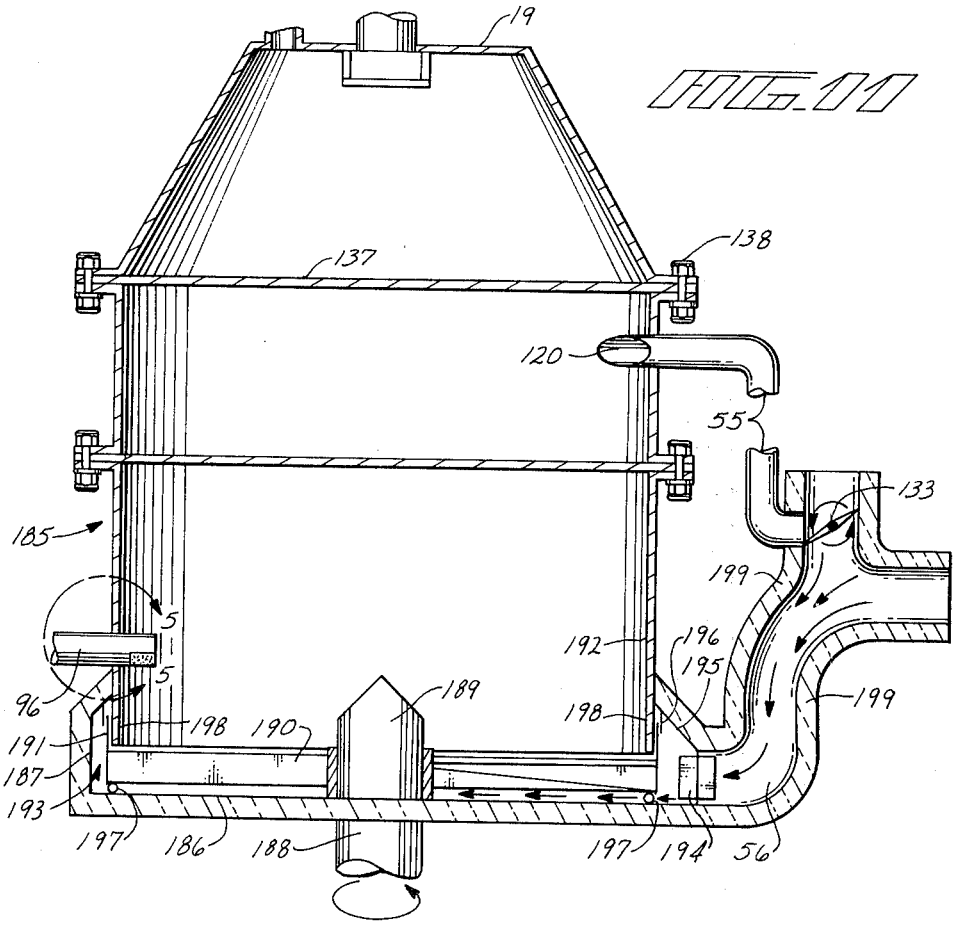

FIG. 11 is a side elevation of an alternate preferred embodiment of a dryer of the type shown in FIG. 7, where relative motion between the floor and the blades is imparted by rotating the blades relative to the floor. In this dryer 185, a stationary floor 186 is integrally formed with a nonrotating outer wall 187. A driveshaft 188 extends through the center of the floor and drives a rotating central hub 189 above the floor. A plurality of rotating ducting blades 190 are secured at their inner ends to the hub and sweep close to the floor. The outer ends of the blades are secured to a rotating annular dam 191 which extends upwardly about half a foot to a foot above the blades. The blades are sloped in the direction of relative motion just as are blades 169 or 64 discussed previously.

If it is desired to operate with a deeper fluidized bed using greater blower pressure, then the dam could extend, for example, 3 or 4 feet above the blades. In any event, the dam should extend about as high as the expected height of the fluidized bed.

The main body of the tank is formed by a baffle 192 which extends downwardly to just above the blades. A sloping wall 195 connects the outer wall to the baffle and forms a gas manifold 193 with the outer wall and dam 191. The outer wall is in communication with a low gas transfer pipe 56 by a set of vanes 194 which directs gas to enter tangentially into the gas manifold.

The embodiment in FIG. 11 differs from the embodiment of FIG. 7 in that there is no need for a rotary seal structure. Instead, an annular lip 196 extends downwardly from sloping wall 195 and hangs over the top of rotating dam 191. The lip is situated outside of the dam as close as is convenient without risk of physical contact. Lip 196 functions as a reentrant orifice to gas entering the manifold so that substantially all gas flow is biased under rotating blades 190 rather than escaping into the space between the lip and the dam.

If desired, the outer edges of the blades may be supported by casters 197 to maintain a constant gap width between the bottom of the blade-duct and the top of the floor. Also, such wheels or casters will provide smoother operation while the blades rotate over the floor.

Figure 13:
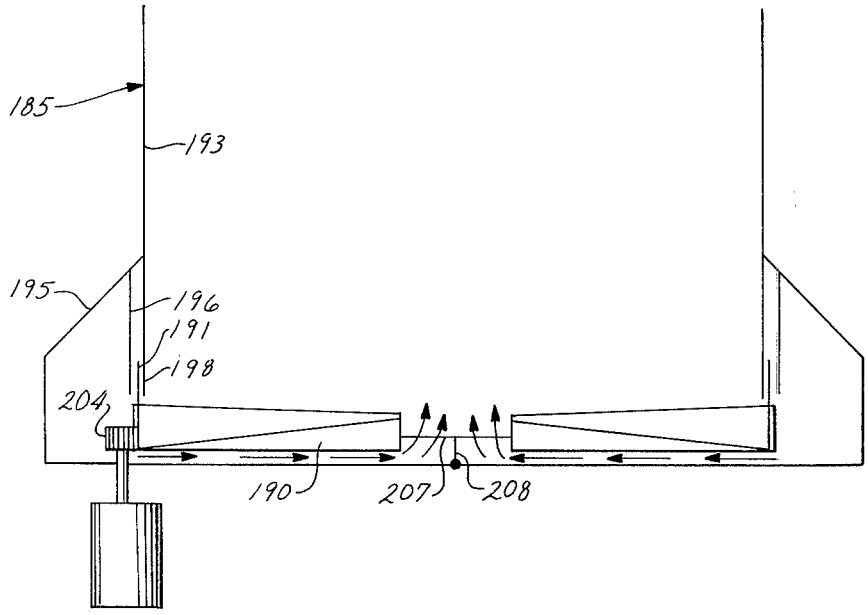
FIG. 13 is a side elevation of another alternate preferred drying tank.

If desired, the blades may be driven by a suitable drive at the outer perimeter, such as a gear and pinion arrangement 204 driving the dam as is shown in FIG. 13. This eliminates the need to drive the hub to rotate the blades. In such a dryer, the hub 189 may be used for centering the blades or eliminated entirely if desired. Of course, without the central hub structure, the dryer can still have a particle drain through the floor if an exit valve is provided in the floor. In the simplest case, the dryer operates without a particle drain through the floor and particle removal occurs solely via elutriation. There is a gap between the inner ends of the blades and gas flows upwardly in the central area. In FIG. 13, the inner ends of the blades are interconnected by a spider 207 supported by an idler pin 208 and bearing to the floor center, providing mechanical support for the inner ends of the blades.

The dryer shown in FIG. 11 has a cylindrical baffle 192 which does not taper. If desired, the baffle can be made to taper outwardly, such as in the dryer of FIG. 1, to facilitate radial expansion of the bed. In any event, it is desirable that the baffle lower edge 198 overhang the blades as close as possible without risk of contact, preferably at about one-quarter inch clearance. From inside the drying space, the overhang extends over dam 191. Thus, any hot pulsating gas which manages to escape the gas manifold through the reentrant orifice defined by lip 196 and dam 191 tends to be directed downwardly into the drying space at the outer edge of blades 190. In this manner, the dryer can fluidize materials without requiring a rotary seal.

In the dryer of FIG. 11, the height of the gas manifold 193 has been reduced relative to the embodiments shown in FIGS. 1 or 7. The height of outer wall 187 can be scaled to approximate the expected thickness of the fluidized bed. For most applications, the outer wall 187 need be only about one foot high.

The reduction of height of the gas manifold permits savings in insulating costs of the dryer since a correspondingly smaller volume of dryer surface need be insulated. In FIG. 11, a layer 199 of insulation shrouds floor 186, gas manifold 193, and the low gas transfer pipe 56.

There is another advantage realized from reducing the height of the gas manifold. The particle inlet 96 can be located in the lower portion of the dryer just above the top of the gas manifold, as shown in FIG. 11. Particles entering the dryer will have a correspondingly shorter distance to fall into the bed in such a configuration, than in the embodiment of FIG. 7.

Figure 12:
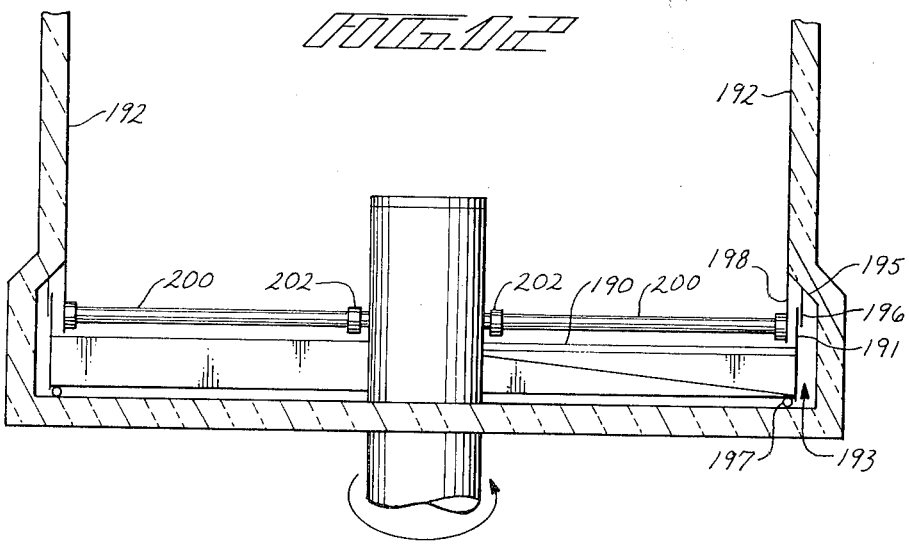
FIG. 12 is a side elevation of another alternate preferred drying tank.

If desired, the dryer of FIG. 11 can be modified to include a set of stationary stirring blades or stator bars 200 which mix the bed above rotating blade ducts 190. Such a structure is shown in FIG. 12, where stator bars 200 are secured at their outer edges to baffle 192. The inner portion of the stators may be attached to a collar 202 around the hub, similar to the arrangement of collar 70 discussed previously in connection with the embodiment illustrated in FIG. 1. The stators are situated just above the blades (preferably about ¼ inch) so they clear the blades as the latter rotate. The function of the stator bars is to impede the bed from moving with the rotating blade ducts as they sweep across the floor. Accordingly a shearing action between the stators and the blades mix the bed.

In the embodiment of the present invention illustrated in FIGS. 8–10, a portable slurry dryer comprises a dryer tank 15 mounted on rigid support frame 52 on a trailer 140. A pulse jet heater and blower package 57 contains a pulse jet engine 80, seen in FIG. 9, which provides pulsating hot gas and sonic energy to the dryer chamber through the low gas inlet transfer pipe 56 and the high gas inlet transfer pipe 55. The tank, the pipes leading to the gas manifold and the auxiliary gas inlet, and conduit 132 from the tank ceiling, as well as the recycle pipes and the pulse jet heater and blower package, are insulated to suppress generation of noise pollution by loss of the sonic energy waves to the environment.

Fuel tank 87 provides fuel for the pulse jet heater package, while air intake 88 provides a supply of fresh air for supercharging the pulse jet engine inlet. The air intake includes supercharging blower 89, while the exhaust end of the pulse jet engine is supplied gas from the recycle streams 130 and 181. The exhaust end includes supercharging blower 151 and diaphragm 150. The blowers are preferably operated by hydraulic drive motor 91.

A slurry pump and drive 97 for extruding particles into the dryer appears in FIGS. 8–10 in a storage position. During operation, screw auger tube 101 is inserted into radial inlet 96 in the side wall of the tank and conveys material from feed hopper 99.

Housing 142 contains controls for the portable slurry dryer. There are also a power unit 91, a fuel tank 92, and hydraulic supply unit 90. The power and hydraulic supply units provide power to operate the various components of the portable slurry dryer, in particular the mechanism for driving the hub, the screw conveyor drive, the particle conveyors, the superchargers, and the cyclone separators. Preferably the power unit comprises a four-cylinder, air-cooled Deutz diesel, although other power units are well known to those skilled in the art and may be used. The hydraulic supply unit includes a hydraulic pump and transmission and a hydraulic fuel reservoir with a cooling tank.

The trailer includes a set of wheels 146 mounted on two parallel axis and a hitch 148 for connection to a cab or the like for transporting the unit. For semi-permanent installations, a skid frame replaces the wheels. The slurry dryer system, while completely self-contained, is portable and can be taken to remote locations, such as fields, as seasonal variations require.

The present invention contemplates fluidizing not only slurry-type materials, but also other moist products, such as granular, finely-divided, or coarse solids.

Persons skilled in the art will appreciate that the preceding description refers to the presently preferred embodiments of the invention illustrated in the accompanying drawings. It will be understood, however, that the present invention can manifest in structural and procedural embodiments different from those described. The preceding description sets forth the presently known best mode of practicing the invention, but has not been presented as an exhaustive catalog of all possible modes. Accordingly, workers skilled in the art will readily appreciate that modifications, alternations of, or variations in, the arrangements and procedures described above may be practiced without departing from, and while still relying upon, essential aspects of this invention.

I claim:

1. An apparatus for fluidizing and drying moist particles, the apparatus comprising:

a tank having a floor with an edge and a central area, and a drying space in the tank above the floor;

means for directing gas in the drying space from the edge to the central area;

means for introducing moist particles into the drying space to form a bed of particles;

means for introducing a fluidizing gas at the edge of the floor, wherein such gas flows into the drying space via the directing means and generates rising streams of gas along the floor to fluidize the bed;

a discharge for withdrawing dried particles from the drying space through the floor; and means for withdrawing gas from the drying space.

2. The apparatus according to claim 1 wherein the discharge comprises an upright annular sleeve concentric with the center of the floor.

3. The apparatus according to claim 2 wherein the gas directing means comprises a plurality of blades, and further comprising a collar around the sleeve, the inner ends of the blades being attached to the collar.

4. The apparatus according to claim 3 wherein the blades extend radially from the collar to the baffle, and further comprising means for securing the blades to the baffle.

5. The apparatus according to claim 4 further comprising means for rotating the floor relative to the blades.

6. The apparatus according to claim 5 wherein the sleeve is secured to the floor, and further comprising means for driving the sleeve to rotate the floor.

7. The apparatus according to claim 6 wherein the blades are nonrotatable.

8. The apparatus according to claim 4 further comprising means for rotating the blades relative to the floor, the floor being stationary.

9. The apparatus according to claim 8 wherein the collar is secured to the sleeve, and further comprising means for driving the sleeve to rotate the blades.

10. The apparatus according to claim 6 additionally comprising stirring means secured to the sleeve above the collar and extending proximate to the baffle.

11. The apparatus according to claim 10 wherein the stirring means comprises a radial arm secured to the sleeve and a plurality of paddles secured to the arm.

12. The apparatus according to claim 11 wherein the radial arm is parallel to the floor.

13. The apparatus according to claim 12 wherein the paddles depend below the arm proximate the blades.

14. The apparatus according to claim 13 wherein such paddles comprise a plate having an outboard leading edge defining an obtuse angle with the radial arm.

15. The apparatus according to claim 14 wherein the paddle closest to the hub comprises a plate having an inboard leading edge defining an acute angle with the radial arm.

16. The apparatus according to claim 15 wherein the stirring means comprises a plurality of such radial arms distributed around the sleeve.

17. The apparatus according to claim 5 or claim 8 wherein the outer wall is integrally formed with the floor.

18. The apparatus according to claim 16 further comprising a rotary seal providing a seal for gases between the wall and the baffle.

19. An apparatus for fluidizing and drying moist particles, the apparatus comprising:

a tank having a floor with an edge and a central area, and a drying space in the tank above the floor, the drying space being enclosed above the floor by a side wall and a top of the tank;

means for directing gas in the drying space from the edge to the central area;

means for introducing moist particles into the drying space from above the directing means to form a bed of particles;

means for imparting relative motion between the bed and the directing means;

means for introducing a fluidizing gas at the edge of the floor, wherein such gas flows into the drying space toward the central area via the directing means and generates rising streams of gas along the floor to fluidize the bed;

a gas outlet at the top of the tank;

means for generating a swirl of gas in the drying space above the fluidized bed cocurrent with the relative motion comprising an auxiliary gas inlet through the side wall for introducing gas on a tangent into the drying space, and additionally comprising an upper horizontal plate and a lower horizontal plate, the upper plate being located proximately below the gas outlet, and the lower plate being located proximately above an annular sleeve extending upwardly into the drying space from the floor, the lower plate being in vertical alignment with the upper plate; and means for withdrawing dried particles from the tank.

20. The apparatus according to claim 19 wherein the support plates are circular.

21. The apparatus according to claim 19 wherein the swirl is adjustable from a strength insufficient for increasing the residence time of particles entrained in such swirl to a vortex having a strength sufficient for effecting centrifugal separation of moisture from such entrained particles.

22. The apparatus according to claim 19 further comprising means for diverting the flow of hot gas from supplying the auxiliary gas inlet to supplying the fluidizing gas introducing means.

23. The apparatus according to claim 22 wherein the fluidizing gas introducing means comprises a gas manifold defined between a baffle above the floor and an outer wall spaced from the baffle, the baffle being integrally formed with the side wall, the gas manifold opening under the baffle into the drying space, wherein fluidizing gas being supplied to the gas manifold flows under the baffle to the edge of the floor.

24. The apparatus according to claim 23 further comprising means for recycling withdrawn gas to a source supplying the fluidizing gas to the gas manifold.

25. The apparatus according to claim 24 wherein the source supplying fluidizing gas comprises a pulse jet engine.

26. The apparatus according to claim 19 wherein the outlet for withdrawing particles is offset from the center of the top.

27. The apparatus according to claim 19 wherein the means for withdrawing dried particles from the tank comprises an outlet in the side wall of the tank.

28. The apparatus according to claim 27 wherein the outlet in the side wall is proximate the top of the tank.

29. The apparatus according to claim 27 further comprising a cyclone separator coupled to the particle outlet.

30. The apparatus according to claim 19 wherein the means for introducing moist particles comprises a particle inlet through the side wall in a radial direction.

31. The apparatus according to claim 30 wherein the particle inlet is above the fluidized bed.

32. A method for fluidizing a bed of particles, the method comprising:

forming a bed of particles in a drying space having bottom and side boundaries;

introducing a fluidizing gas into the drying space from a periphery of the bottom boundary, the fluidizing gas having radial and tangential components of motion when it is introduced;

directing a portion of the fluidizing gas from the periphery into a central ara of the drying space to generate rising streams of such gas along the bottom boundary for fluidizing particles in the bed; and fluidizing the bed with a time average uniform exposure of the bed to the fluidizing gas by continuously changing the exposure of particles in the bed to the gas streams.

33. The method according to claim 32 wherein the step of continuously changing the exposure of particles in the bed to the streams of fluidizing gas comprises imparting relative motion between the bed and the places of generation of such streams, the relative motion being greater at a side periphery of the drying space than in a central portion of the drying space.

34. The method according to claim 33 wherein the step of imparting relative motion comprises rotating a floor for supporting the bed relative to a ducting blade for generating the streams of fluidizing gas.

35. The method according to claim 33 wherein the step of imparting relative motion comprises rotating a ducting blade for generating the streams of fluidizing gas relative to a floor for supporting the bed.

36. The method according to claim 33 wherein the step of imparting relative motion comprises shearing the bed proximate the places of generation of such streams.

37. The method according to claim 32 further comprising the step of lifting and dropping the bed, and expanding the bed radially as the bed is lifted.

38. The method according to claim 32 further comprising the step of pulsating the fluidizing gas before introducing such gas into the drying space.

39. The method according to claim 32 further comprising the step of introducng sonic energy into the drying space with the fluidizing gas.

40. A method for fluidizing a bed of particles, the method comprising:

forming a bed of particles in a drying space having bottom and side boundaries;

introducing a fluidizing gas into the drying space from a periphery of the bottom boundary;

directing a portion of the fluidizing gas from the periphery into a central area of the drying space to generate rising streams of such gas along the bottom boundary for fluidizing particles in the bed;

fluidizing the bed with a time average uniform exposure of the bed to the fluidizing gas by continuously changing the exposure of particles in the bed to the gas streams;

generating a swirl of gas in the drying space above the fluidized bed; and withdrawing dried particles from an upper portion of the drying space.

41. The method according to claim 40 wherein the step of withdrawing dried particles comprising generating a negative gas pressure gradient for causing gas to flow from the fluidized bed to the upper portion of the drying space, entraining particles in the flow of gas, and withdrawing the flow of gas from the upper portion of the drying space.

42. A method for fluidizing a bed of particles, the method comprising:

introducing moist particles into a drying space to form a bed of particles on a floor;

imparting relative motion between the bed of particles and a gas directing means along the floor; and pulsating hot gas and flowing such gas into the drying space from the periphery of the floor and through the gas directing means from its periphery toward a central portion to generate a flow of upwardly and inwardly extending streams of hot gas across the floor which contact particles to fluidize the bed.

43. The method according to claim 42 wherein the step of imparting relative motion comprises rotating the directing means relative to the floor.

44. The method according to claim 42 further comprising generating a swirl of gas in the drying space above the fluidized bed current with the relative motion, adjusting the swirl for controlling the residence time of particles entrained in the swirl, the swirl being adjustable from substantially no strength to a strength sufficient for effecting centrifugal separation of moisture and such entrained particles, and diverting gas from generating the swirl to augmenting the gas flow for fluidizing the bed.

45. An apparatus for fluidizing and drying moist particles comprising:

a tank having an upright cylindrical wall integrally formed with a rotatable floor;

an annular baffle within the tank concentric with the wall and spaced from the wall and the floor to define a gas manifold between the wall and the baffle which opens under the baffle into a drying space above the floor, the drying space being enclosed above the baffle by a side wall, integrally formed with the baffle, and a top of the tank;

an annular upright sleeve through the floor;

means to drive the sleeve to rotate the floor;

a collar above the floor around the sleeve;

a plurality of blades adjacent the floor extending radially from the collar and secured to the baffle, the blades being sloped in the direction of relative motion of the floor;

a plurality of rotating stirring arms above the blades and extending radially from a ring fixed to the sleeve above the collar to a location proximate to the baffle, such stirring arms including a plurality of paddles depending below the arm;

a radial inlet through the side wall for introducing moist particles into a side periphery of the drying space above the blades to form a bed of particles;

a pulse jet engine having an inlet exhaust, and a tailpipe exhaust arranged for supplying pulsating hot gas and sonic energy to the gas manifold, whereby the pulsating hot gas and sonic energy flow from the gas manifold under the baffle and the blades into the drying space to cause the bed of particles to fluidize and dry;

an outlet for withdrawing gases in the center of the top;

a lower circular horizontal plate proximately above the annular sleeve and vertically aligned with an upper circular horizontal plate proximately below the outlet for gases in the center of the tank top;

an auxiliary gas inlet for introducing pulsating hot gases and sonic energy into the drying space on a tangent to the side wall, the auxiliary inlet being supplied by the inlet exhaust of the pulse jet engine, whereby pulsating hot gas and sonic energy enter the drying space through the auxiliary inlet and circulate concurrently with the floor motion to generate a swirl of gas above the fluidized bed between the horizontal plates;

means for adjustably diverting the flow of pulsating hot gas and sonic energy, provided by the inlet exhaust, from supplying the auxiliary gas inlet to augmenting the supply to the gas manifold, whereby to adjust the swirl, from a vortex having a strength sufficient for effecting centrifugal separation of moisture and particles entrained in the vortex, to a swirl having substantially no strength, the flow of gas into the drying space effecting a negative pressure gradient from the fluidized bed to the top of the tank, whereby gas containing moisture follows the gradient and is withdrawn through the gas outlet in the center of the tank top, and gas containing entrained particles follows the gradient and is withdrawn through an outlet offset from the gas outlet; and means for recycling withdrawn gas to the tailpipe end of the pulse jet engine.

46. The apparatus according to claim 45 further comprising a diaphragm for separating the atmosphere at the inlet end of the pulsejet engine from the atmosphere at the tailpipe end, and further comprising means for supercharging the oxygen content of the atmosphere at the inlet end to support combustion in the pulse jet engine.

47. An apparatus for fluidizing and drying moist particles comprising a tank having a floor and an enclosed drying space;

means for introducing moist particles into the drying space to form a bed of particles;

means for flowing hot gas into the drying space from the edge of the floor to contact particles and fluidize the bed;

means for introducing hot gas tangentially into the drying space to cause gas to swirl above an annular upright sleeve extending into the interior of the tank from the center of the floor, the swirling gas for removing moisture from particles entrained therein, the upright sleeve dividing the drying space into a fluidized bed region below a swirl region and comprising an overflow drain for the fluidized bed; and means for withdrawing gases from the drying space.

48. An apparatus for fluidizing and drying moist particles, the apparatus comprising:

a tank having an upright wall and a floor with an edge and a central area, and a drying space in the tank above the floor;

an upright annular sleeve extending into the drying space through the center of the floor;

a baffle around the edge of the floor spaced from the wall and the floor to define a gas manifold between the wall and the baffle in communication under the baffle with the drying space;

a plurality of blades adjacent the floor, the blades being located about the sleeve and extending to the baffle;

means for imparting relative motion between the floor and the blades;

means for introducing moist particles into the drying space above the blades to form a bed of particles;

means for supplying a fluidizing gas to the gas manifold, whereby the fluidizing gas flows from the gas manifold under the baffle and the blades into the drying space to cause the bed of particles to fluidize and dry, the blades being sloped in the direction of relative motion to provide a leading edge and a raised trailing edge located further above the floor than is the leading edge, the leading edge being sufficiently close to the floor for sweeping particles off the floor and shearing the bed along the top of the blades over the trailing edge, the trailing edge directing the hot gas into the drying space cocurrently with the relative motion;

a gas outlet in the tank for withdrawing gases; and means for withdrawing dried particles from the tank.

49. The apparatus according to claim 48 wherein the leading edge forms an included angle from about 15° to about 45° with the floor.

50. The apparatus according to claim 48 wherein such blades additionally comprise a skirt depending from the trailing edge toward to the floor.

51. The apparatus according to claim 50 wherein the skirt tapers from a maximum depth near the baffle to a minimum depth near the sleeve.

* * * * *

UNITED STATES PATENT AND TRADEMARK OFFICE

CERTIFICATE OF CORRECTION

PATENT NO. : 4,395,830

DATED : August 2, 1983

INVENTOR(S) : RAYMOND M. LOCKWOOD

It is certified that error appears in the above-identified patent and that said Letters Patent is hereby corrected as shown below:

Col. 1, line 41, "drying" should read --dryer --
Col. 4, line 59, "powwer" should read -- power --
Col. 10, line 3, "board" should read -- broad --
Col. 10, line 56, "wet-test" should read --wettest --
Col. 20, line 65, "axis" should read -- axles --
Col. 21, line 16, "alternations" should read -- alterations --
Col. 23, line 37 (Claim 32, line 10), "ara" should read -- area --
Col. 24, line 2 (Claim 29, line 2), "introducng" should read -- introducing --
Col. 24, line 23 (Claim 41, line 2), "comprising" should read -- comprises --
Col. 24, line 47 (Claim 44, line 3), "current" should read -- cocurrent --
Col. 25, line 23 (Claim 45, line 47), "concurrently" should read -- cocurrently --
Col. 26, line 31 (Claim 48, line 13), "about" should read -- around --

Signed and Sealed this

*Fifteenth* Day of *October 1985*

[SEAL]

*Attest:*

*Attesting Officer*

DONALD J. QUIGG

*Commissioner of Patents and Trademarks—Designate*